United States Patent [19]

Choi

[11] Patent Number: 4,962,884

[45] Date of Patent: Oct. 16, 1990

[54] HEAT ACCUMULATING TYPE ELECTRIC UNDERFLOOR HEATING SYSTEM HAVING UPPER AND LOWER CAVITIES AND A METHOD FOR HEATING THE SAME

[76] Inventor: Young T. Choi, 292-52, Imoon-Dong, Tongdaemoon-ku, Seoul, Rep. of Korea

[21] Appl. No.: 400,555

[22] Filed: Aug. 30, 1989

[30] Foreign Application Priority Data

Aug. 30, 1988 [KR] Rep. of Korea ..... 11023/88

[51] Int. Cl.[5] ..... F24D 5/10

[52] U.S. Cl. ..... 237/69; 219/213; 98/103

[58] Field of Search ..... 237/69; 98/103, 104; 219/213

[56] References Cited

U.S. PATENT DOCUMENTS

| | | | |
|---|---|---|---|
| 2,422,685 | 6/1947 | Kock | 237/69 |
| 2,660,409 | 11/1953 | Pittenger, Jr. et al. | 237/69 |
| 2,783,639 | 3/1957 | Werner | 237/69 |
| 3,936,661 | 2/1976 | Furuishi et al. | 219/213 |
| 3,991,937 | 11/1976 | Heilemann | 237/69 |
| 4,190,761 | 2/1980 | Colten | 219/213 |
| 4,459,973 | 7/1984 | Royer . | |
| 4,508,162 | 4/1985 | Radtke | 237/69 |
| 4,689,470 | 8/1987 | Cunningham | 219/213 |
| 4,878,332 | 11/1989 | Drake | 219/213 |

*Primary Examiner*—Henry C. Yuen

*Attorney, Agent, or Firm*—Flynn, Thiel, Boutell & Tanis

[57] ABSTRACT

An underfloor heating system includes structure defining vertically adjacent upper and lower communicating cavities beneath the floor of a room to be heated. A noncombustible heat source is provided in the lower cavity. Barriers are arranged in both cavities to define communicating compartments therein. The heat source includes an arrangement for directing hot air produced thereby through the compartments in the lower cavity. The cavities communicate such that hot air passes first through the lower cavity compartments, then through the upper cavity compartments, and back to the heat source.

6 Claims, 4 Drawing Sheets

HEAT ACCUMULATING TYPE ELECTRIC UNDERFLOOR HEATING SYSTEM HAVING UPPER AND LOWER CAVITIES AND A METHOD FOR HEATING THE SAME

REFERENCE TO RELATED APPLICATION

The subject matter disclosed in this application is related to the subject matter disclosed in my co-pending application U.S. Ser. No. 07/220 001 filed July 15, 1988, the disclosure of which is hereby incorporated herein by reference.

FIELD OF THE INVENTION

The present invention relates to a heat accumulating type electric underfloor heating system having upper and lower cavities and a method for heating the same.

BACKGROUND OF THE INVENTION

Still more particularly, the invention relates to an underfloor heating system and a heating method using same. By use of nighttime generated electric power, much and inexpensively, much heat (heat energy) is regenerated heat and the underfloor is heated by radiating the accumulated heat kept for a long time even after the power is cut off.

The well known method for heating a room or a chamber is to generate heat from heat sources such as various boilers or the like installed at the outside of the room, to transfer much heat energy through pipes or ducts by heat transfer media such as water, steam and air, and to radiate heat on the underfloor of the room. Therefore, in the above method, much heat loss is produced through the heat source and the course of the heat transfer, and the related facilities are very complex. Various materials and their used amounts are much required. Further, the above method requires much material, labor and cost for construction. By use of briquette as fuel sources, fuel wastes are produced and cause harm to the public. In particular, the heating method using hot water circulation through piping has a complicated operation, along with problems of leakage, lower heat efficiency and short life.

Therefore, the inventor has provided an underfloor heating system as a heating means to be used for heating traditional Korean type structures in order to prevent air pollution (or environmental pollution) and maximize heating effect.

The present invention is a device which aims to use the merits of the underfloor heat system, developing more efficiently the invention for which my Korean Patent Application Nos. 653/1988, 2496/1987 and 8847/1987 (corresponding to U.S. Ser. No. 07/220 001) were filed previously.

The objects of the present invention include: (1) improving the heat accumulating effects, (2) extending heat energy holding time uniformly and to the utmost for the radiating heat amounts within the radiating heat time, (3) cheaply providing an underfloor heating system having an upper cavity and a lower cavity and using nighttime generated electric power and radiating heat on the panel.

SUMMARY OF THE INVENTION

The underfloor heating system according to the present invention includes structure defining vertically adjacent upper and lower communicating cavities beneath the floor of a room to be heated. A noncombustible heat source is provided in the lower cavity. Barriers are arranged in both cavities to define communicating compartments therein. The heat source includes an arrangement for directing hot air produced thereby through the compartments in the lower cavity. The cavities communicate such that hot air passes first through the lower cavity compartments, then through the upper cavity compartments, and back to the heat source.

BRIEF DESCRIPTION OF THE DRAWINGS

An explanation thereof will be given hereunder according to drawings attached hereto in which.

DETAILED DESCRIPTION

Figure 1:
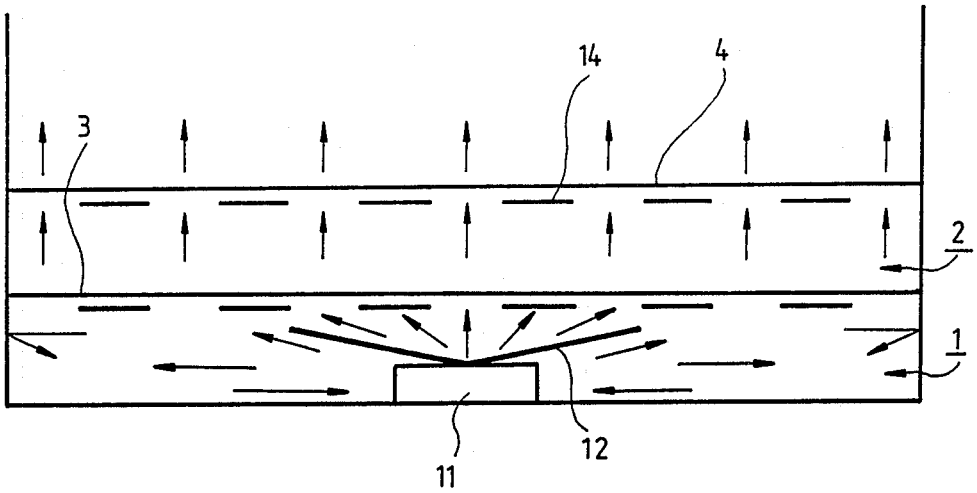
FIG. 1 is a detailed view diagrammatically showing the principle of a first embodiment of the underfloor heating system of the present invention.
Figure 2:
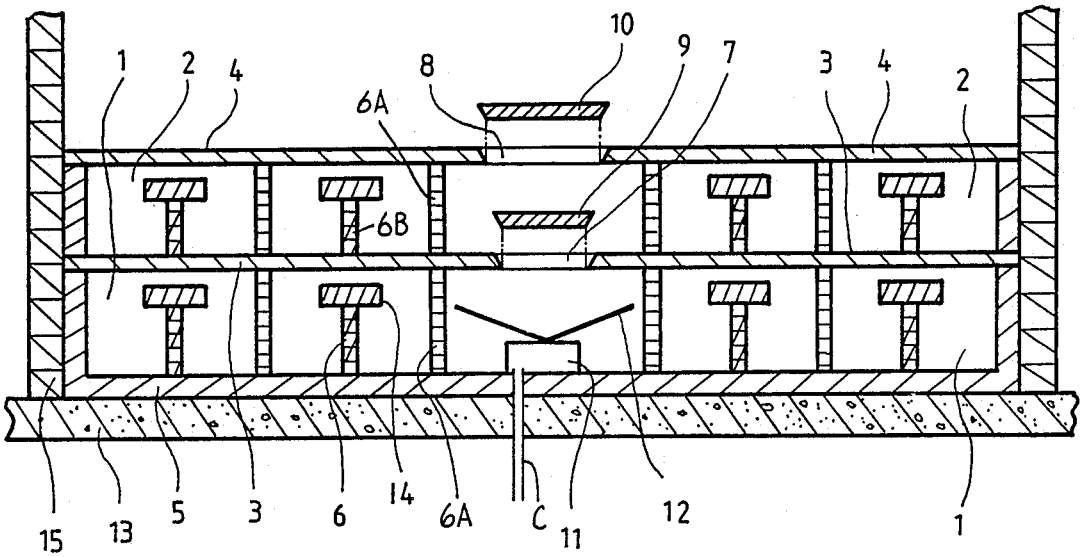
FIG. 2 is a sectional view of the first embodiment of the underfloor heating system depicted in FIG. 1.
Figure 3:
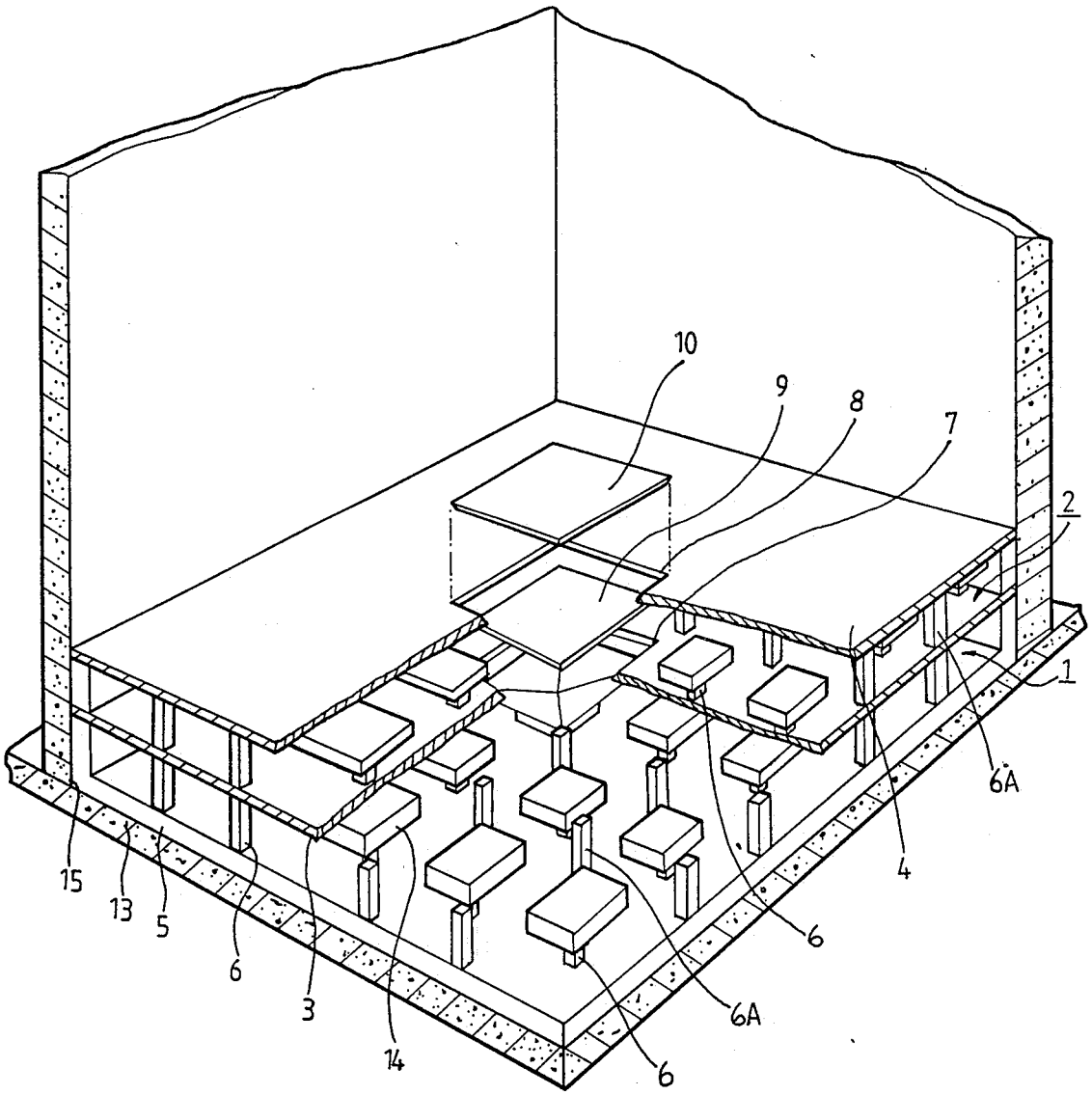
FIG. 3 is a partially cutaway perspective view of the first embodiment of the underfloor heating system of the present invention shown in FIG. 2.
Figure 4:
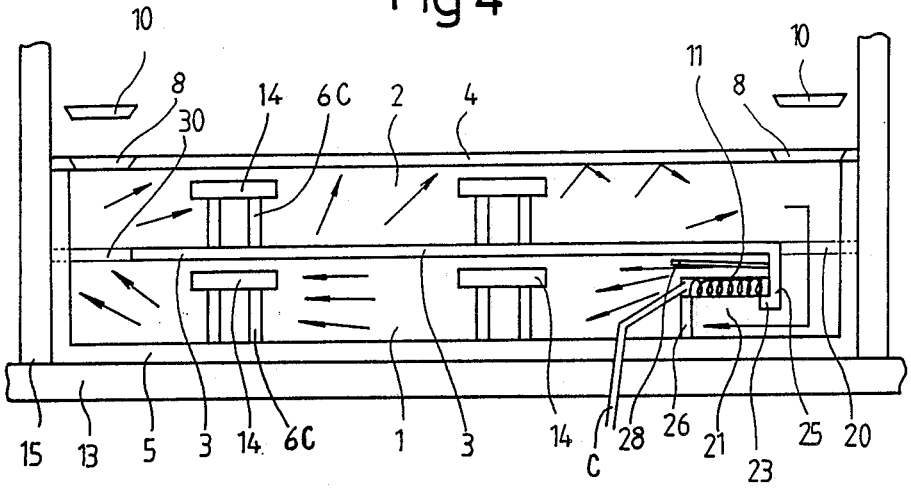
FIG. 4 is a sectional view showing an operational state of a second embodiment of the underfloor heating system of the present invention.
Figure 5A:
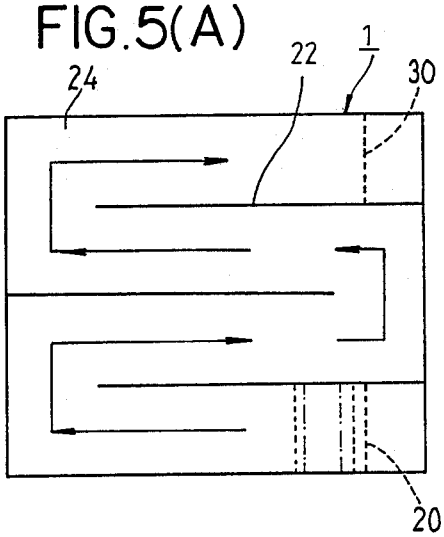
FIGS. 5 (A) and (B) are diagrammatic plan views respectively showing the circulation of heated air within the lower cavity and the upper cavity according to the second embodiment of the present invention shown in FIG. 4.
Figure 5B:
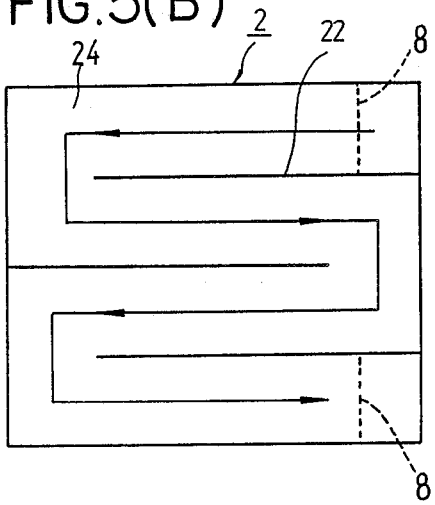
Figure 6:
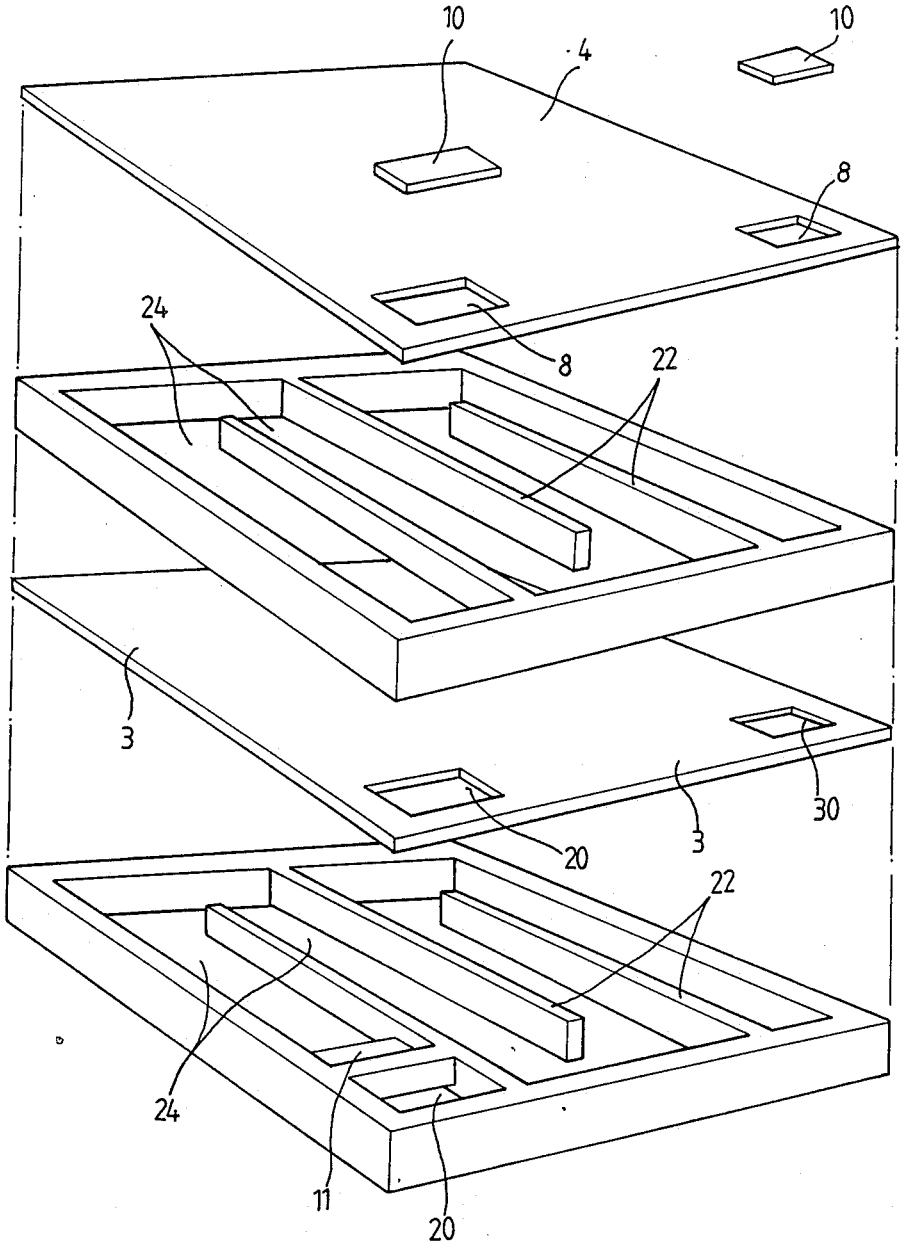
FIG. 6 is an exploded perspective view of a portion of the second embodiment of the present invention shown in FIG. 4.

FIG. 1 to FIG. 3 show one embodiment of the present invention, and FIG. 4 to FIG. 6 another embodiment of the present invention.

In the drawings of FIGS. 1 to 3, an adiabatic layer 5 is attached to a bottom support surface 13 and outer walls 15. Also, a plurality of auxiliary support columns 6 and auxiliary heat accumulating members 14, which are supported panels, are installed. The auxiliary support columns 6 are supported on the support surface 13, and the members 14 are supported on the columns 6. A lower panel 3 is supported between the walls 15 and above the members 14 and, if necessary on intermediate support pillars or walls 6A. A lower opened part or opening 7 is formed in the panel 3 and is covered by a removable lower cover 9. A heat source 11 is installed on the adiabatic layer 5, and has a hot air diffusion plate 12 located underneath the lower opened part 7. The lower cover 9 is inserted into the lower opened part 7 to form a lower airtight cavity 1 between the lower support surface 13 and the lower panel 3.

In a similar manner, an upper airtight cavity 2 is formed above the lower panel 3. That is, an upper panel 4 is supported between the walls 15 and above the lower panel 3 and, if necessary on intermediate support pillars or walls 6A. The panel 4 includes an upper opened part or opening 8 therein, which is covered with a removable upper cover 10, thus forming the upper airtight cavity 2. The opening 8 is formed over the lower opened part 7. Thus, the upper cavity 2 is formed between the panels 3 and 4. Auxiliary support columns 6B are supported on the lower panel 3 in the cavity 2, and auxiliary heat accumulating members 14 are supported on the auxiliary columns 6B. Accordingly, a heat accumulating type electric underfloor heating system having upper and lower airtight cavities is provided.

In the embodiment of FIGS. 4 to 6, wherein analogous elements are designated with the same reference numerals as in FIGS. 1–3, the adiabatic layer 5 is formed on the bottom support surface 13 and the outer walls 15, and compartments 24 defined by barrier walls 22 are provided for circulation of hot air. Further, in the place of installation of a heat source on one side of a room, a hot air-returning opened side wall 25, a hot air supplying opened side wall 26 and a counter flow prevention member 23 are provided, and the hot air from the upper cavity 2 is supplied by passing through a hot air supplying inlet 21, defined between the side walls 25 and 26, and a hot air-return opening 20 formed in the lower panel 3. The side walls 25 and 26 are parallel and extend respectively from the lower panel 3 and the lower support surface 13 into the cavity 1. A heat source (or electric heat producing apparatus) 11 is provided with a hot air guiding plate 28 and is installed in the hot air supplying inlet 21.

By installing the compartment barrier walls 22 on the lower panel 3 and the adiabatic layer 5, the compartments 24 are formed in both cavities 1 and 2. Auxiliary heat accumulating members 14 are properly arranged in both cavities within the compartments 24 and supported on auxiliary columns 6C as discussed above. The hot air from the lower cavity 1 is, in turn, circulated through the compartments 24, and then diffused within the upper cavity 2 through a hot air opening 30 formed in the lower panel 3 opposite the air-return opening 20. Within the upper cavity 2, the hot air is circulated through the compartments 24 and then descends downwardly through the hot air-return opening 20 of the lower panel 3. Thus, a closed circulation path is formed to circulate the hot air because the hot air is supplied to the heat source 11 from the hot air supplying inlet 21 adjacent the opening 20.

The upper panel 4 above the upper cavity 2 has a pair of opened parts or openings 8 formed therein which receive coVers 10. The openings 8 are respectively located above the hot air-return opening 20 and the hot air opening 30.

Accordingly, hot air from the heat source is circulated in one direction through the compartments 24 of the bottom airtight cavity 1, and then through the hot air opening 30 and the compartments 24 of the upper airtight cavity 2. Next, the hot air is returned to the heat source 11 in the hot air supplying inlet 21 through the hot air-return opening 20.

In both above-described embodiments, the heat source 11 is preferably electric, and is connected to a power source (not shown) by a conductor C, as shown in FIGS. 2 and 4.

As described above, a heat accumulating type electric underfloor heating system having an upper cavity 2 and a lower cavity 1 to circulate hot air is provided.

That is, a hot air closed type underfloor heating system is realized by the upper cavity 2 and the lower cavity 1 of FIG. 2, and also by the upper and lower cavities of FIG. 4, which form a hot air circulating type underfloor heating system. Although the cavities 1 and 2 of the embodiment of FIG. 4 are by their structure not technically airtight, together they form a composite airtight cavity having two communicating cavities therein.

An object of the present invention is to reduce the difference between the maximum temperature and minimum temperature on the panel surface for 24 hours, and to much retain hot air accumulating amount and uniformly maintain room temperature at any time.

Referring to FIGS. 1–3, when the heat source 11, which is disposed in the bottom airtight cavity 1 of the hot air closed type underfloor heating system, is run (operated), the contacted air is heated and the hot air is diffused by the hot air diffusion plate 12. The hot air through the diffusion heats the support columns 6, auxiliary heat accumulating members 14 and lower panel 3, and heat is accumulated.

Next, convection flow occurs within the bottom airtight cavity 1 and the hot air is transferred on the lower panel 3, auxiliary heat accumulating member 14 and support column 6 from the heat source 11, resulting in much accumulated heat. By passing heating time, heat is radiated from the surface of the lower panel 3.

When heat is accumulated on the lower panel 3, and the temperature t1 on the bottom of the upper airtight cavity 2 is equal to the temperature t2 on the lower surface of the lower panel 3 ($t1=t2$), the effect is that of having another heat source within the upper airtight cavity 2. Thus, the auxiliary support columns 6A, 6B, auxiliary heat accumulating members 14 and the upper panel 4 of the upper cavity 2 also are heated and the heat is accumulated as described above. That is, because the underfloor heating system comprises the lower airtight cavity 1 and the upper airtight cavity 2, the system has effects of accumulating heat and radiation by heating. Hours for heating, accumulating and radiating heat in this system are at the maximum extended. Accordingly, before the room temperature's lowering time, it becomes reheating time and the room temperature can be uniformly maintained for 24 hours regardless of heating time.

In the circulated type electric underfloor heating system of FIGS. 4–6, the hot air, which is heated by electric heat source 11, passes along the compartments 24 of the lower cavity 1 as directed by the hot air guiding plate 28, and then along the compartments 24 of the cavity 2 after passing through the hot air opening 30. The air, its temperature now cooling, passes along the compartments 24 of the cavity 2, and finally reaches the air-return opening 20. The air is drawn into the heat source 11 from the air supplying inlet 21 and circulated along the compartments 24 of the lower cavity 1, thus forming a continuous closed circuit.

The heated air is circulated along the compartments 24 of the lower and upper airtight cavities 1,2 and transfers heat produced by the heat source 11. Then the heated air heats the compartment barrier walls 22, the auxiliary support columns 6C and the auxiliary heat accumulating members 14, lower panel 3 and upper panel 4 to accumulate heat. The heated air is uniformly radiated on the surface of the upper panel 4 and a sufficient amount of heat is provided within the room above. At that time, the room or chamber is warmly maintained regardless of heating time and non-heating time. Of course, a heating effect analogous to that shown in FIG. 1 and described above with respect to the embodiment of FIG. 2 is present (to a lesser extent) in the embodiment of FIGS. 4–6.

In the prior art underfloor heating system, the room is warmly maintained for 24 hours by heating 2 or 3 times per day. Further, during the non-heating time, cooling air continuously passes along the compartment through the fuel hole or furnace and the panel of the system is cooled. Accordingly, the prior art system has much loss of heat by cooling the panel. Composition ratio for stone slab material and clay in the panel of the prior art underfloor heating system is in the range of about 40:60, and in the concrete panel, composition ratio for cement mixture and gravel is in the range of 43:57. In the above two types of panels, specific gravity, specific heat, heat capacity and density have values in similar ranges, and the amount of accumulating heat also is almost the same.

In the inventive underfloor heating system having the upper and lower cavities, the panels are comprised of an upper part layer and a lower part layer as dual structures, and much heat is retained for a long time within the airtight structure. The room or chamber can be warmly maintained by such amount of heat for a few days or tens of days by one time heating, depending upon the weather condition and the heating requirements of the room being heated. In particular, in case the period for heating the room is relatively long as in Korea from autumn to spring, the inventive underfloor heating system having the upper and lower cavities always maintains a uniform temperature distribution in the heated room because the hot air passes along the support columns 6, the compartment barriers 22, lower panel 3 and upper panel 4 with the convection, circulation, conduction and radiation for above listed members (2,22,3,4) carried out by the hot air to continuously transfer heat through the lower cavity 1 and the upper cavity 2.

According to the underfloor heating system of the present invention, boilers, circulating pump, oil tank, water tank, various pipings, filling materials, insulating materials and all the associated facilities which are required by the existing, heating room method are not required, and all cost related to maintenance, installation and materials for the above listed elements, necessary in the existing heating room method, are not required. Because the present invention has an noncombustible heat source, many of the above-listed failures produced by the above existing method can be overcome by the present invention.

The present invention is epoch-making in terms of economical efficiency achieved without thermal loss, by use of nighttime generated electric power. It discharges no harmful gas in the air and is so simple in structure that materials, construction period, and labor can be reduced to a minimum.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a closed type heat accumulating electric double underfloor heating system including a lower support surface and outer walls installed with an adiabatic layer; a noncombustible heat source connected with a conductive line and positioned in an airtight cavity, the improvement comprising:

a plurality of members of auxiliary heat accumulating material supported on, columns fixed on a lower panel and on the adiabatic layer; a lower opened part formed in said lower panel, a lower cavity being formed between said lower panel and said lower support surface; an upper cavity is provided between said lower panel and an upper panel, the upper panel having an upper opened part formed therein, the lower opened part and the upper opened part are formed on a straight line direction whereby said cavities are conveniently accessed; an upper cover is fixedly but removably inserted in the upper opened part of the upper panel whereby said upper cavity is formed; when the heat source is operated, convection is formed within said lower cavity and the lower panel, support columns and members of auxiliary heat accumulating material are heated, accumulated by heat, and radiated whereby the upper cavity is heated, accumulated by heat and radiated on the surface of the upper panel.

2. The underfloor heating system according to claim 1, wherein said heat source includes a hot air diffusion plate, said heat source being positioned on said lower support surface, said heat source being aligned with said opened parts in said straight line direction, said lower opened part being centrally located in said lower panel, a lower cover being removably inserted in said lower opened part, said upper and lower cavities being airtight.

3. The underfloor heating system according to claim 1, including barriers fixedly installed on said lower panel and on said adiabatic layer above said lower support surface, said barriers defining compartments in said cavities, said heat source including a hot air guidance plate, first and second side walls extending between said lower support surface and said lower panel in said lower cavity, said side walls defining therebetween a hot air supply inlet, said heat source being fixedly secured between said side walls in said inlet, said lower opened part defining a hot air return opening in said lower panel, heated air from the heat source is simultaneously expanded by heat and is directed within the lower cavity compartments by the hot air guidance plate and is also directed within the compartments of the upper cavity from a hot air rising opening formed in said lower panel, and the air within the upper cavity is supplied to the area of the heat source from the hot air supply inlet and through the hot air-return opening whereby a closed circulation is formed.

4. A method for heating using an underfloor heating system, in which a noncombustible heat source is connected with a conductive line and positioned in an airtight cavity, said underfloor heating system including members of auxiliary heat accumulating material arranged within lower and upper cavities and supported on support columns fixedly installed on a lower panel and on a lower support surface, said lower cavity being provided between said lower support surface and said lower panel, a lower opened part being formed in said lower panel, said upper cavity being provided between said lower panel and an upper panel, and upper opened parts being formed in said upper panel, comprising the steps of:

heating an accumulating heat in the lower panel, support columns and members of auxiliary heat accumulating material of the lower cavity, and radiating heat therefrom using hot air as heat transfer media;

then heating an accumulating heat in the upper panel, the support columns and the members of the upper cavity, and radiating heat therefrom using the hot air, whereby proper heat is radiated from the upper surface of the upper panel;

radiating the hot air on the upper surface of the upper panel and heating a chamber or a room by the hot air; and uniformly heating a room for a fixed time period after the noncombustible heat source is cut off and the hot air is not supplied, by radiating accumulated heat.

5. The method according to claim 4, wherein said upper and lower opened parts are covered, whereby said upper and lower cavities are airtight, and wherein said heat source includes a heat diffusion plate.

6. The method according to claim 4, including first and second side walls extending between said lower support surface and said lower panel in said lower cavity, said heat source including a hot air guidance plate, said side walls defining therebetween a hot air supply inlet, said heat source being fixedly secured between said side walls in said inlet, said lower opened part defining a hot air return opening, said lower panel having a hot air rising opening formed therein, barriers fixedly installed on said lower support surface and on said lower panel, said barriers defining compartments in said cavities, said method including the further steps of:

guiding hot air produced from the heat source into and through the compartments of the lower cavity by means of the hot air guidance plate and the compartment barriers;

directing the hot air from the lower cavity upwardly through the hot air rising opening and into the compartments of the upper cavity; and directing cooled hot air from the upper cavity into the area of the heat source through the hot air supply inlet and the hot air-return opening whereby a closed type circulation of air to be heated again is formed.

* * * * *

UNITED STATES PATENT AND TRADEMARK OFFICE

CERTIFICATE OF CORRECTION

PATENT NO. : 4 962 884

DATED : October 16, 1990

INVENTOR(S) : Young Taik CHOI

It is certified that error appears in the above-identified patent and that said Letters Patent is hereby corrected as shown below:

Column 5, line 64; delete ",".

Signed and Sealed this

Twenty-eighth Day of April, 1992

*Attest:*

HARRY F. MANBECK, JR.

*Attesting Officer*

*Commissioner of Patents and Trademarks*